US008109231B1

(12) United States Patent
Weisenberg et al.

(10) Patent No.: US 8,109,231 B1
(45) Date of Patent: Feb. 7, 2012

(54) IMPARTED CHARGE IN SITU PIPELINING DEVICE

(76) Inventors: Kent Weisenberg, Englewood, FL (US); Dudley Primeaux, II, Elgin, TX (US)

( * ) Notice: Subject to any disclaimer, the term of this patent is extended or adjusted under 35 U.S.C. 154(b) by 0 days.

(21) Appl. No.: 13/178,574

(22) Filed: Jul. 8, 2011

Related U.S. Application Data

(62) Division of application No. 12/963,312, filed on Dec. 8, 2010, now Pat. No. 7,992,514.

(51) Int. Cl.
*B05B 7/10* (2006.01)
*B05B 5/025* (2006.01)
*B05B 13/06* (2006.01)

(52) U.S. Cl. ..... 118/622; 118/629; 118/317; 239/402; 239/406; 239/290; 239/706

(58) Field of Classification Search ..... 118/621–623, 118/629, 631, 54, 55, 302, 306, 317, 318, 118/323, 626; 528/44, 64, 66, 68, 74.5, 76, 528/77, 80, 81, 85; 427/476, 236, 239, 424, 427/427.4; 239/223, 224, 699–708, 402, 239/406, 290, 295
See application file for complete search history.

(56) References Cited

U.S. PATENT DOCUMENTS

| | | | | |
|---|---|---|---|---|
| 2,520,397 | A | 8/1950 | Green | |
| 3,159,895 | A | 12/1964 | Perovich | |
| 3,606,892 | A | 9/1971 | Huff et al. | |
| 4,341,347 | A * | 7/1982 | DeVittorio | 239/3 |
| 4,414,918 | A | 11/1983 | Holland et al. | |
| 4,421,790 | A | 12/1983 | Nagata et al. | |
| 4,499,118 | A | 2/1985 | Dietz et al. | |
| 4,601,921 | A * | 7/1986 | Lee | 427/240 |
| 5,092,265 | A | 3/1992 | Hughes et al. | |
| 5,681,623 | A | 10/1997 | Ferralli | |
| 5,718,027 | A | 2/1998 | Laumann | |
| 5,951,761 | A | 9/1999 | Edstrom | |
| 6,632,475 | B1 | 10/2003 | Bleggi | |
| 7,338,687 | B2 | 3/2008 | Davis | |

FOREIGN PATENT DOCUMENTS

| | | |
|---|---|---|
| GB | 1136206 | 12/1968 |
| GB | 1150810 | 5/1969 |

* cited by examiner

*Primary Examiner* — Yewebdar Tadesse
(74) *Attorney, Agent, or Firm* — David McEwing

(57) ABSTRACT

The invention pertains to a lining device that can be pulled through a pipe having an approximate diameter between 1 and 36 inches. The device sprays an electrically charged lining mixture 360° onto the inside pipe surface. The lining mixture is electro-statically charged to facilitate full encapsulation and adhesion to all pipe wall surfaces in a circumferentially uniform thickness. The lining device can be contained in a multipart housing having flexible rod-like components that hold the device in the center of the longitudinal axis of the pipe. The lining mixture is conveyed to the device through heated non expanding hose. The non expanding properties facilitate the delivery of the lining under pressure to the device. The device also incorporates a dwell cone having a knurled edge that atomizes the lining mixture as it is centrifugally thrown onto the pipe wall. The device may further incorporate nitrogen in mixing the lining material.

8 Claims, 15 Drawing Sheets

SECTION A-A

IMPARTED CHARGE IN SITU PIPELINING DEVICE

RELATED APPLICATIONS

This application is a Divisional Application of application Ser. No. 12/963,312 filed Dec. 8, 2010 now U.S. Pat. No. 7,992,514 and entitled "Imparted Charge In Situ Pipelining Device." This application incorporates by reference herein Ser. No. 12/611,305, entitled Apparatus and Method for Lining Large Diameter Pipe with an Environmentally Compatible Impervious Membrane" filed Nov. 3, 2009, Ser. No. 12/476,983 and now U.S. Pat. No. 7,726,256. This application also incorporates "Method and Apparatus for Lining Pipes with Environmentally Compatible Impervious Membrane" by reference, Ser. No. 12/476,983 filed Jan. 2, 2009 and now U.S. Pat. No. 7,591,901.

BACKGROUND OF INVENTION

1. Field of Invention

This disclosure pertains to the distribution of drinking water within existing piping systems in buildings and structures. With general infrastructure within the US and around the world in a precarious state of decay it has been the object of many to provide for a cost effective method to perform in situ-rehabilitation of these properties. In the global arena, water distribution systems are seriously compromised with failures creating community disturbances, commercial loss and environmental incidents. In the industrial sector, pipe and transmission lines carrying volatile and dangerous or hazardous materials are constantly at risk of failure due to age, neglect or lack of funds to replace or repair with traditional methods.

This disclosure permits the lining of potable water pipes in situ in commercial and residential buildings with no adverse affects to human occupants. The disclosure eliminates the "remove and replace" method of rehabilitating water distribution systems. This eliminates the disruption of old existing asbestos insulation and removal of lead painted walls. Avoiding the distribution of these known carcinogens and toxic substances is of great value to the workers and building occupants and the environment. In addition the method of the disclosure installs lining (and thereby isolates) lead soldered joints of water piping systems. This eliminates further contamination.

The NSF/ANSI 61-2010 standard approves lining of water distribution pipe systems utilizing electrically charged lining material that are attract to and adhere to the pipe wall during the lining process due to the fact that the pipe system has been electrically grounded. This method eliminates the chance of the lining not encapsulating every surface of the pipe wall.

2. Description of Related Art

Prior art demonstrates numerous methods to rehabilitate pipelines, conduits and passageways from the inside in order to restore asset integrity.

Removal of pipes is unsatisfactory since it often creates dispersion of asbestos dust or lead paint. In situ relining of small diameter pipes following convoluted paths is greatly preferable and environmentally non-hazardous.

SUMMARY OF INVENTION

The invention pertains to a lining device that can be pulled through a pipe having an approximate diameter between 0.750 inches and 36 inches. The device sprays an electrically charged lining mixture 360° onto the inside pipe surface. The lining mixture is electro-statically charged to facilitate full encapsulation and adhesion to all pipe wall surfaces in a circumferentially uniform thickness.

The lining material can be premixed an conveyed to the device through a heated, non-expanding hose. The heating maintains a low viscosity. The heated hose may be contained in an umbilical also conveying an electric cable, a CCTV cable and pressurized air hose. The umbilical may also contain an insulated chilled nitrogen hose. The nitrogen may be exhausted into the atomized pipe lining material to increase lining build up.

The lining device can be contained in a multipart housing having flexible rod-like components that hold the device in the center of the longitudinal axis of the pipe. The lining device can be pulled through at least a part of a building or structure potable water distribution pipe system comprising straight pipes and multiple 1 to 90 degree bends, tees and multiple diameters.

SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

DETAILED DESCRIPTION OF INVENTION

Figure 1:
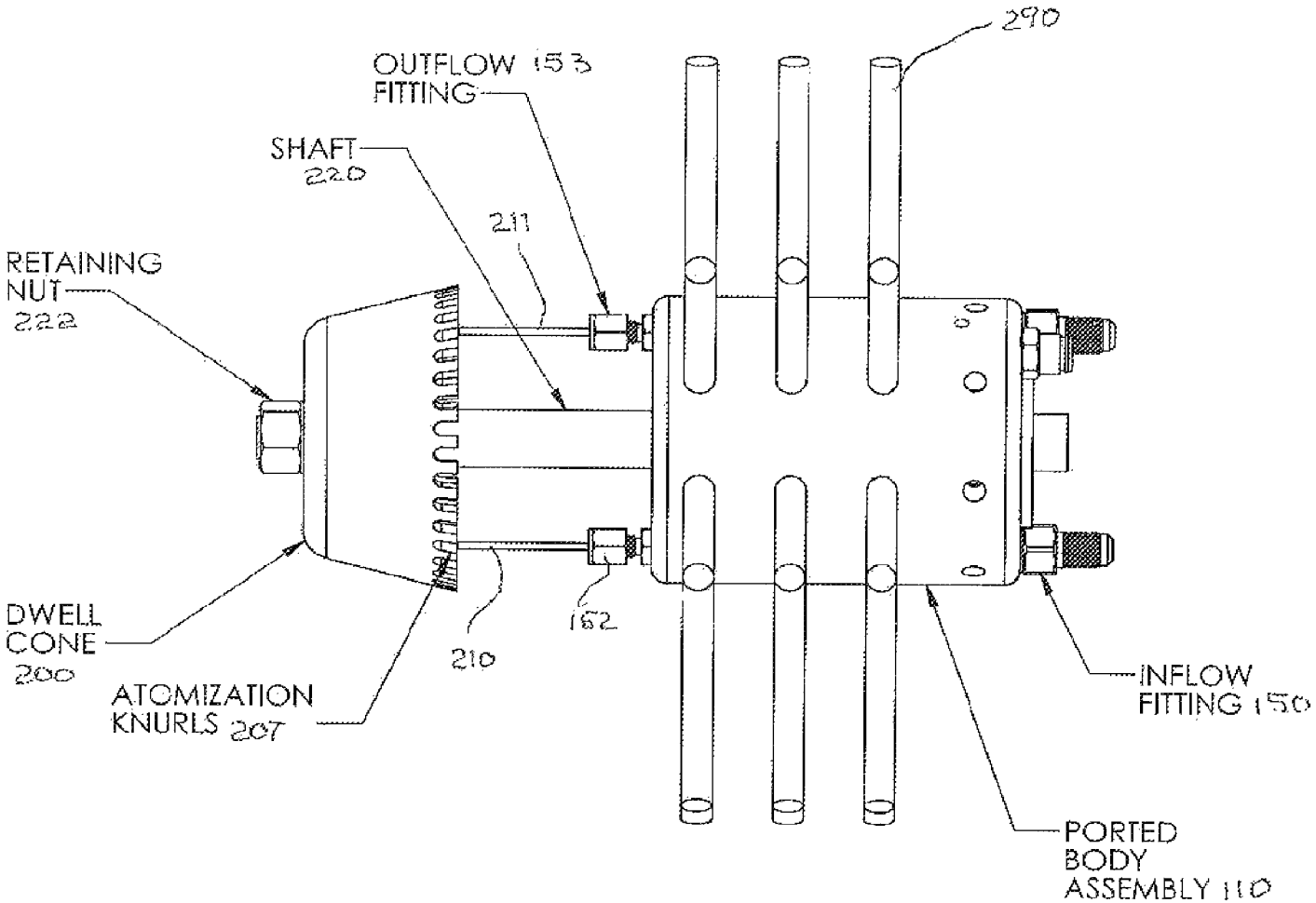
FIG. 1 is a side view of the lining device showing the first ported body assembly, inflow and outflow fittings, dwell cone with atomization knurls and rotor shaft. Also illustrated are pipe centering components protruding from the ported body assembly.

The invention pertains to a lining device that can be pulled through a pipe having an approximate diameter between 1 and 36 inches. The device is connected to an umbilical at a second ported assembly body. The umbilical conveys pipe lining material to the device. The lining hose within the umbilical is heated and non-expanding. This allows the lining to be mixed at a remote location and pumped under pressure to the dispenser apparatus. The second ported assembly body ("second housing") conveys the lining mixture into two branches that are conveyed to a first front end of a first ported body assembly ("first housing"). The multi-part housing connected with flexible hose allows the apparatus to navigate tight turns in the pipe. The lining mixture passes over wave/pulse generation tabs mounted within the two lining annulus of the first housing.

Due to the small size of the apparatus having the ability to traverse 90° angle, the lining apparatus can be installed into the piping system through existing accesses in the municipal drinking water and fire protection/deluge sectors. Accesses such as clean out, valves and hydrants can be used. Prior art epoxy lining devices and other method all require excavation of large areas and the cutting open of the pipe to access for installation of lining devices. This creates a huge environmental impact as the earth, existing foliage, roads, sidewalks, etc. have to be torn up to facilitate access. These excavations can also create traffic delays.

The liner is dispersed from two exit ports ("trajectory/static charging orifices") extending from the second back end of the first housing in a stream that strikes a rotational drive receptacle mounted in a dwell cone. The exit port is dimensioned to emit the pressurized lining at a predetermined angle so that the force of the emitted liner rotates the rotational drive receptacle and dwell cone at a high rate of speed. The rotational drive and dwell cone rotate together on a rotating shaft. The shaft turns on bearings within the first housing. The shaft has a reciprocating motion as well as a rotational motion.

The juncture of the rotational drive receptacle and the dwell cone form a pocket shape or space. The liquid liner flows across the surface of the rotational drive receptacle to the pocket. The liner material has an opportunity dwell within the pocket and where the curing process can continue. The liner material is pulled by centrifugal forces up the side wall of the dwell cone to the knurling edge. The device disperses the lining 360° around the interior wall of the pipe.

Connected to the rotating shaft within the first assembly body is an internal air assist component. It comprises a two function turbine. It assists in initially rotating the shaft as the trajectory/velocity of the fluid from the trajectory/static charging orifices is slow in initiating rotation of the dispersion cone. The rotation of the dispersion cone is assisted with air flow from the air driven turbine. The air assist turbine is powered by a compressed air hose included with the umbilical. The air turbine assist mechanism facilitates creating the initial rotation of the shaft in that it cohesively provides, in conjunction with the energy of the fluid stream, the initial energy necessary to expedite the shaft to immediately achieve full RPM necessary to disperse the liner 360° around the pipe surface. The second function is the turbine creating a venturi effect. The turbine is encapsulated within the first housing. The turbine is mounted in a bore configuration that when the turbine spins it utilizes the exhausting air to create a venturi effect. This venturi effect pushes high volumes of the exhaust air backwards and subsequently out of the first housing at the bottom. This air is then utilized to remove debris in the path of the housing dispersing the lining as the housing traverses backwards (pulled by the umbilical or tether). The air assist component creates a cleaning mechanism for the pipe to be lined. The turbine blades are flat and almost vertical to the bearing with sufficient slope to create a directed exhaust flow while not sacrificing torque.

For smaller diameter pipe, i.e., ¾ inch, the device can operate without a dwell cone and rotating shaft. This is advantageous due to the size of the rotating dwell cone and proximity to the pipe wall. Instead, the lining material is dispersed from a combination liquid spray orifice and air sprayer orifice. The air from the air sprayer orifice atomizes the liquid lining. The fine spray charged particle lining is immediately attracted to the pipe wall surface.

In another embodiment, the invention discloses a two stage nitrogen process. There will be a designated hose in the umbilical that will deliver nitrogen from a pressurized tank to the remote apparatus. The first part of this is to cool the product immediately prior to spraying. As disclosed, the mixed lining material is conveyed to the apparatus in a heated hose to lower the viscosity of the product to provide the ability to pump it over 600 feet. This in turn makes the product thinner when it is being sprayed and not allow for high build up. The product cure time may be delayed. The nitrogen hose will be separated from the heated hose in the umbilical via insulation until the very end of the umbilical within a 12 inches from the apparatus. The nitrogen hose will then coil around the fluid hose to cool the heated product prior to dispersion. This will raise the viscosity therefore increasing the liner build up that can be achieved on the pipe wall. The second function of the nitrogen stream is that when it is exhausted at the end of the coil it in effect dispenses all oxygen from the area making the unit intrinsically safe.

The umbilical attached to the second housing also contains an electrical cable. Further, the umbilical can contain a CCTV cable to allow utilization of a television camera on one of the housings.

The mounted to the first and second housing are a plurality of centering components (prongs or bristles) protruding from the ported assembly housings. These components function to maintain the housing in the center of the pipe's longitudinal axis. The multi-prongs also maintain the apparatus within the center axis of the pipe. This is particularly useful as the apparatus is pulled through corners and bends of the pipe. It will be appreciated that the prongs have flexibility and can maintain the center position of the apparatus in differing diameter pipes. The prongs are superior to prior art methods that use flexible or spring loaded arms radiating from the housing at 90 or 120 degree intervals. These prior art devices can not traverse a short radius 90° pipe bend or elbow. The angle to too acute and the flexible or collapsible arms would jam in the bend. (Such devices are only suitable for traversing long radius bends.) Unfortunately, short radius elbow and tees are used in standard building water distribution piping systems. Secondly the prior art would to get caught up/stuck at any coupling fittings within these pipes. The system of the present disclosure allows for dispersion dwell cone centering in any of the aforementioned configurations.

As stated, the lining component does carry an electrical charge after flowing through the conductor or folic orifice(s). The charge can be imparted in the liner by passing the lining flow through a positively charged wire or conductor orifice prior to the stream being emitted from an exit port. The charged stream is attracted to the grounded pipe wall. It will be appreciated that the pipe wall will have a negative charge. The lining will be positively charged and electrically attracted to the interior pipe wall, thereby facilitating improved bonding of the liner to the pipe wall. The adhesion of the positively charged liner to the negatively charged pipe surface also facilities the holding of the liner without sagging during cure. Additionally, the positive charged liner encompasses all microscopic profiles and undulations in the pipe wall surface due to this inherent attraction irrespective of their initial configuration or placement.

A method and apparatus is disclosed for the remote and robotic in situ or facility installation of an organic, monolithic pipe liner. The liner is electro-statically applied. The liner is approved for potable water. The liner may be a polyurea. The lining may provide structural reinforcement of the pipe. The method and apparatus allows installation of lining through convoluted pipe systems with internal diameters ranging from 1" to 36".

In regard to high rise building applications, use of polyurea lining has a high elongation. Current method utilize epoxies that have very low elongation and are brittle. The epoxies are prone to crack when they are subjected to thermal cycling and or pressure 'slams' that originate from turning on and off pressurized pipe systems, e.g. faucets, etc. The polyurea lining material is better suited for water pipe lining systems.

FIG. 1 illustrates a first ported assembly body 110 ("first housing"). As will be shown, there is a second ported assembly body connected to an umbilical. The umbilical is connected to a liner supply pump, an electrical supply, an air supply and at least a CCTV control and monitor. The umbilical may also be connected to a nitrogen supply. The device may be pulled through the pipe using the umbilical. The umbilical may contain a tether. Returning to FIG. 1, the assembly contains two inflow fittings 150, 151. The inflow is from the second housing mentioned above. Each fitting receives the lining mixture through a flexible tube from the second ported body assembly (second housing). The lining mixture is conveyed through an annulus within the assembly (not shown) and is ejected under pressure through an orifice tube 210, 211 to a trajectory/static charging orifice 240 illustrated in FIG. 2. Returning to FIG. 1, also illustrated is the rotating shaft 220 to which a dwell cone 200 is mounted with a retaining nut 221. As will be discussed, the rotating shaft turns on bearings within the first housing. The rotating shaft may also reciprocate in a forward and reverse direction relative to the longitudinal axis of the pipe. Also illustrated are the atomization knurls 207 contained in the edge of the dwell cone. The rotating shaft may also be driven by rotation of an air powered turbine within the first housing. This is particularly useful in starting motion of the housing by air pushed by the turbine rapidly turning the rotating shaft and the rotational drive receptacle and dwell cone at sufficient RPM to disperse the lining material onto the pipe wall.

Figure 2:
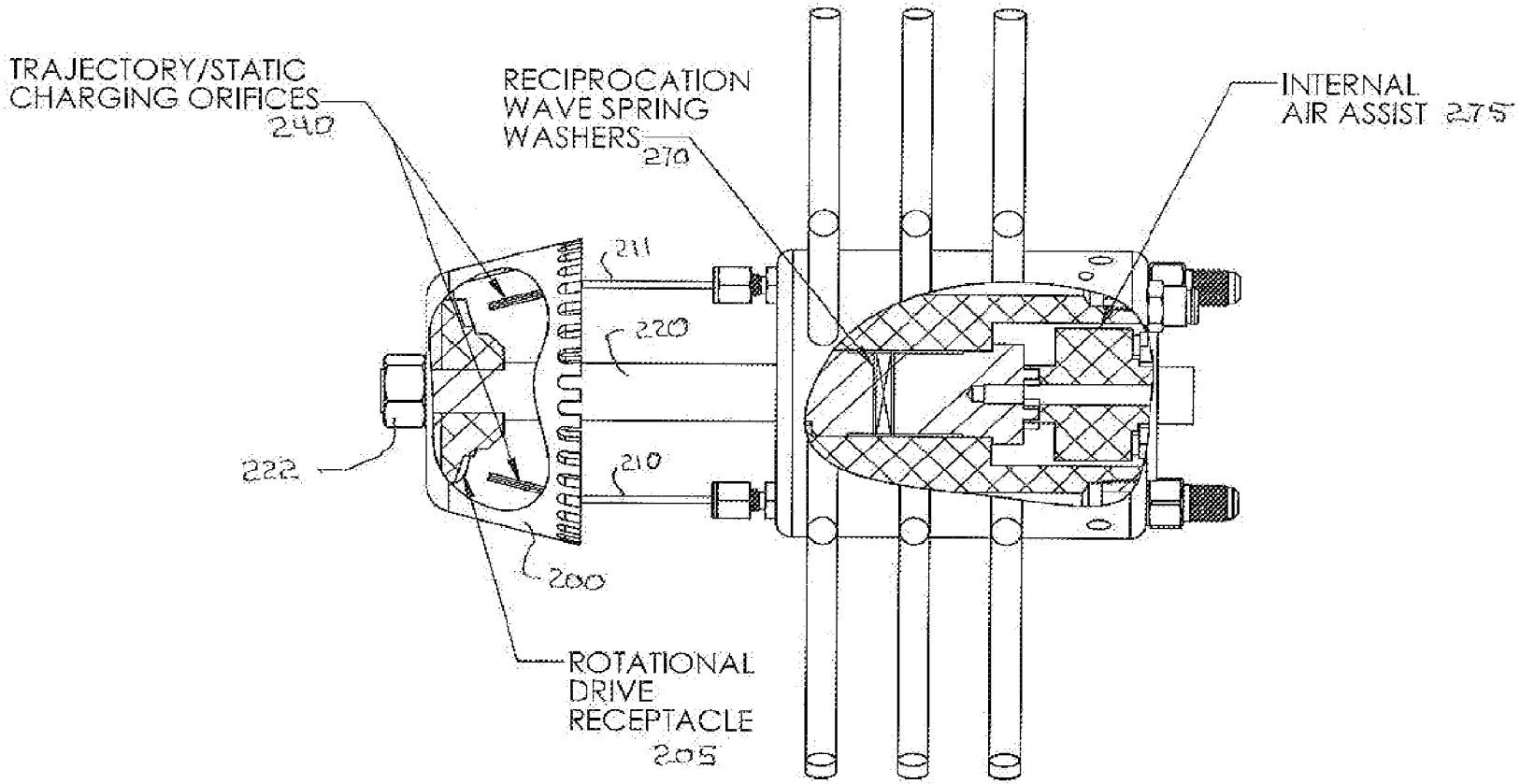
FIG. 2 is a partial cut-away side view of the lining device illustrating the dwell cone and trajectory/static charging orifices. Also illustrated is an internal air assist component within the liner assembly body.

FIG. 2 illustrates a partial cutaway view of the ported body assembly (first housing) 110 and the dwell cone 200. Illustrated are the bearings 231 facilitating rotation of the shaft 220. The orifice tubes 210, 211 are illustrated extending to the directed or dimensioned trajectory/static charging orifices 240. The orifices are directed at an angle to a rotational drive receptacle 205. The heated lining mixture is emitted from the orifices under pressure. The heated lining may have a low viscosity that facilitate atomization. The two orifices receive fluid flow from the ported body. The lining flow is electrically charged due to their contact with the static charge conductor plate. (See FIG. 5.) The lining material is forced at high pressure through the trajectory static charging orifices and the aligned trajectory is such that it impacts the machined angular mortises in the rotational drive receptor at a precise acute angle to facilitate cohesive rotation of both the dwell cone and rotational drive receptacle. The shaft is seated into a linear thrust bearing inside the first housing. The stream of lining mixture strikes the engineered surface of the rotational drive receptacle causing the receptacle and attached dwell cone to rapidly rotate. The centrifugal force of the spinning components forces the lining mixture to travel outward on the inner cone surface and over the cone edge. The lining mixture is thrown on to the inside wall surface of the pipe (not shown). The serrated edge (atomization knurls) 207 of the dwell cone atomizes the lining mixture applied to the pipe surface. This facilitates an even coat of lining being applied to the pipe surface. The cone and rotational drive receptacle are held with a retaining nut 221.

Figure 3:
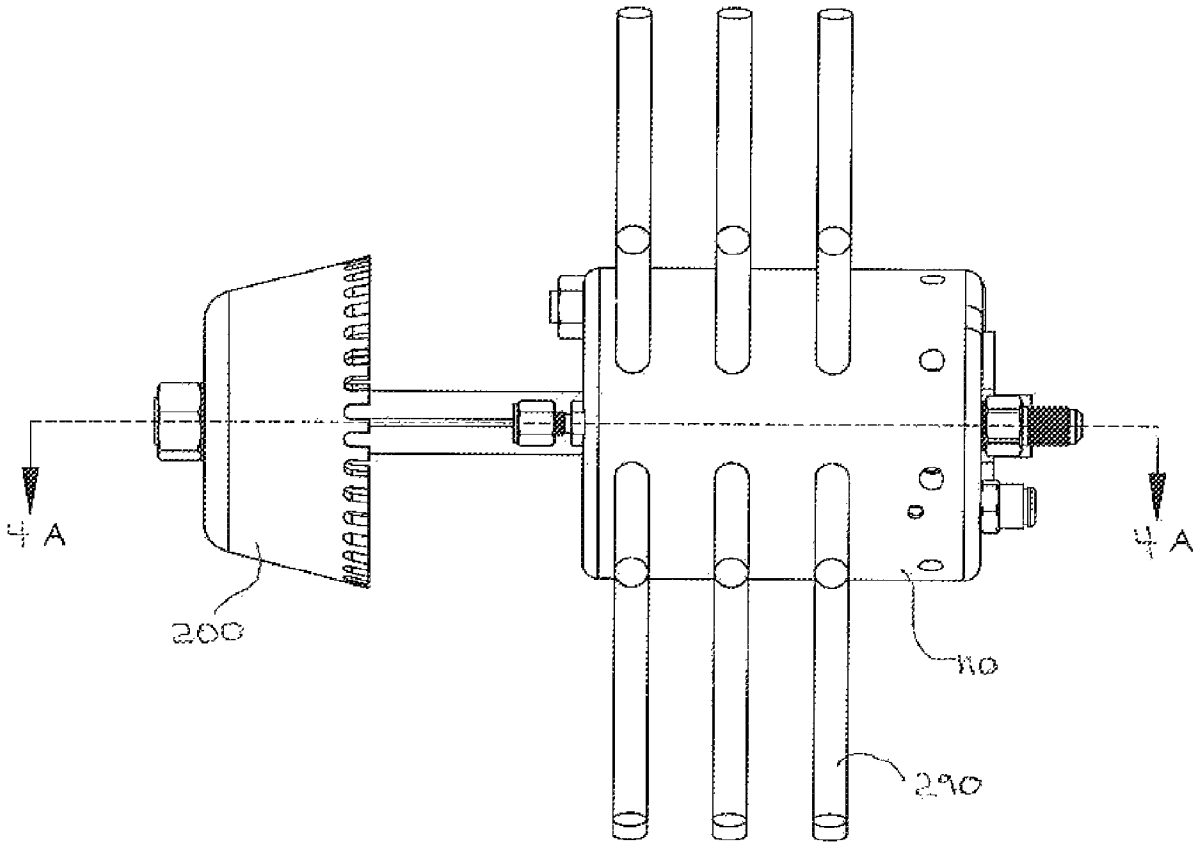
FIG. 3 illustrates a side view of the first ported body assembly and rotational drive receptacle showing the view of FIG. 4.

FIG. 3 illustrates a side view of the first ported body assembly 110 and dwell cone 200. Also illustrated are the centering components (prongs or bristles) 290 protruding from the ported body assembly.

Figure 4:
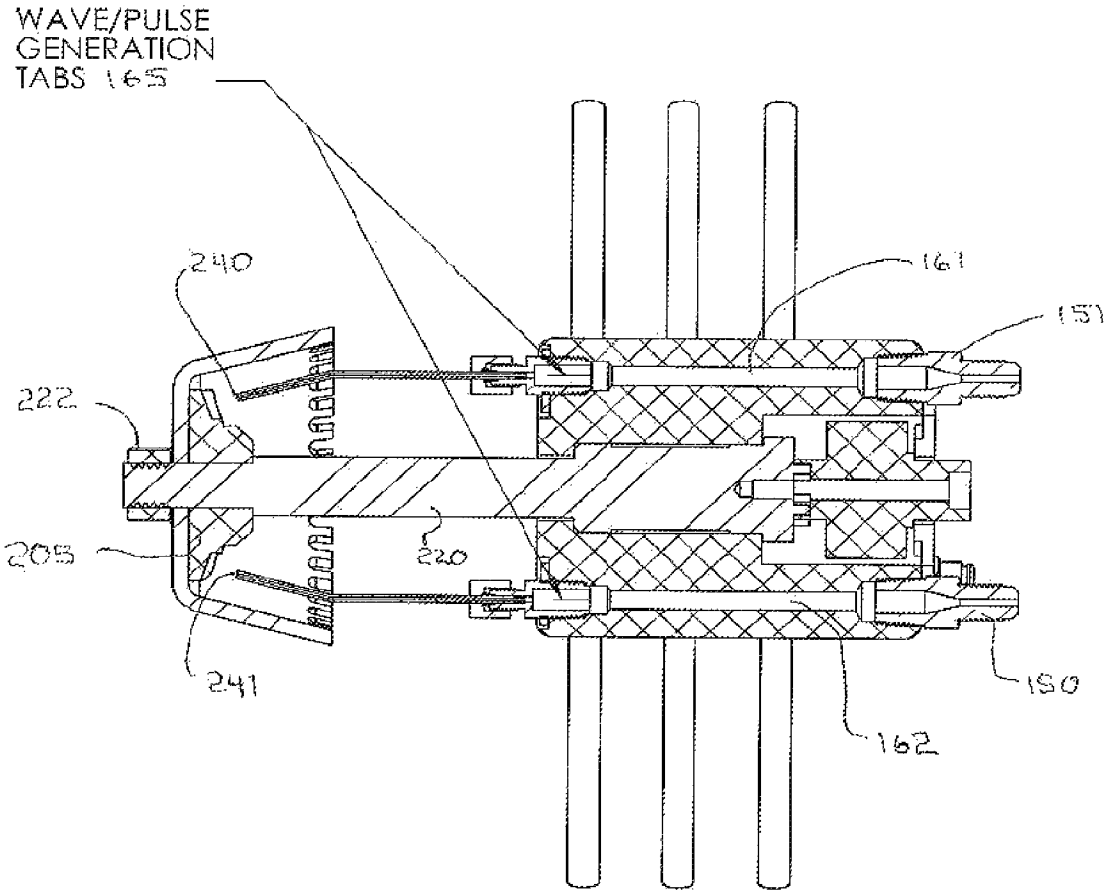
FIG. 4 is a cross sectional view of the liner assembly body and dwell cone. Illustrated is the rotational drive receptacle, the rotating shaft and wave pulse generation tabs.

FIG. 4 illustrates a cross section view of the ported body assembly, rotating shaft, dwell cone and rotational drive receptacle 205. Also illustrated are the trajectory/static charging orifices 240, 241. FIG. 4 illustrates a cross sectional view of inflow fittings 150, 151, the lining mixture flow annulus 161, 162, the wave/pulse generation tabs 165 positioned within the lining mixture flow annulus, the orifice tubes 210, 211 and the angled trajectory/static charging orifices 240, 241 directed at the rotational drive receptacle 205. Also illustrated is the rotational shaft 220 and retaining nut 221. It will be appreciated that the progressive narrowing of the annulus 161, 162 to annulus orifice tubes impinges the lining mixture thereby increasing the lining flow rate.

The wave pulse generation tabs are semi flexible inserts that are attached to the interior of the port assembly inside the first ported body assembly. The wave/pulse generation tabs afford a wave effect by creating a vortex in the product flow in each trajectory/static charging orifices. This vortex results in millisecond undulations or "flutters" of the lining flow in each trajectory/static charging orifice. This fluttering dissipation of the lining flow from the trajectory/static charging orifice as it impacts the rotating drive receptacle creates an interconnected horizontal reciprocating pulsing motion in the shaft, the rotating drive receptacle and dwell cone. This pulsating motion is then significantly magnified by the reciprocation wave spring washers encompassed around the shaft and seated in the ported body assembly. The reciprocation wave spring washers creates an inertia in the shaft linear to the fluttering impact energy being exerted on the rotating drive receptacle from the product streams out of the trajectory static charging orifices. In one embodiment, this reciprocating motion may be between 0.125 inch and 0.250 inch. This reciprocation allows for a more uniform distribution of the material off of the dwell cone in turn affording higher product flows without resulting in drips or sags in the lining.

Figure 5:
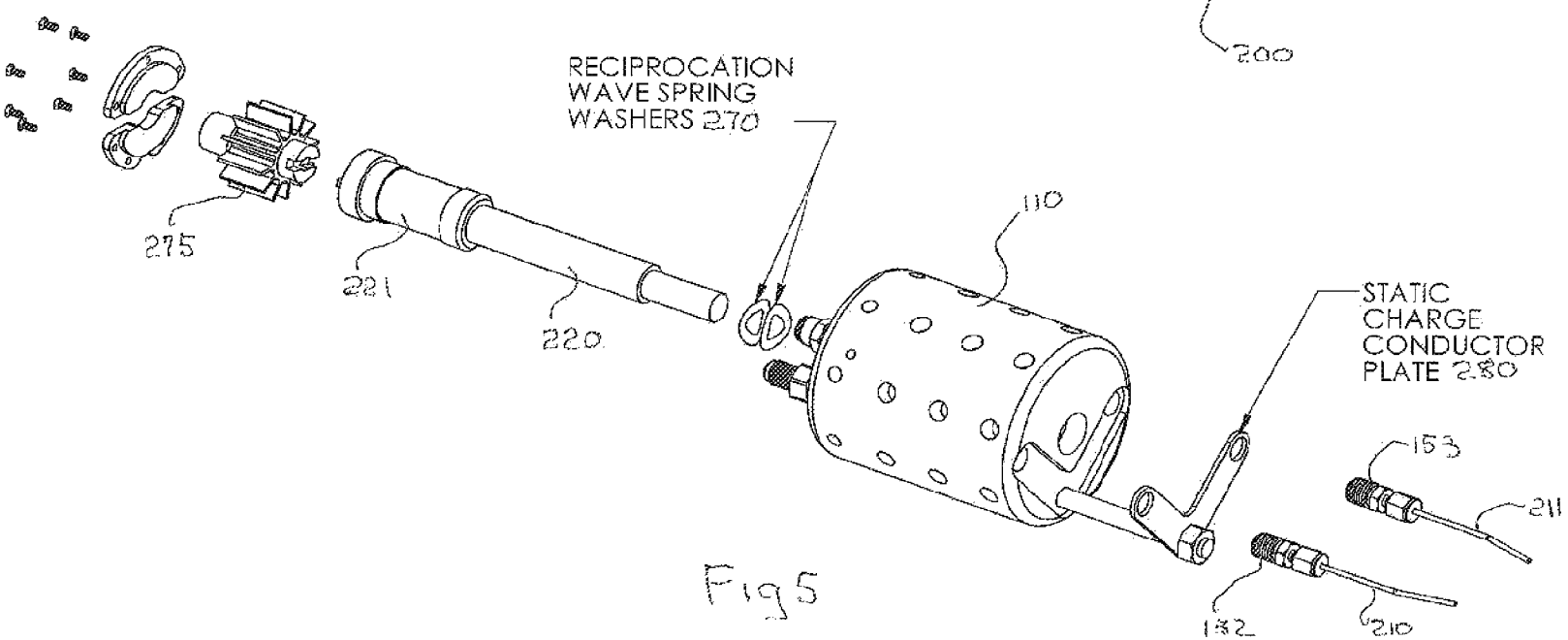
FIG. 5 illustrates an exploded view rotary shaft and component contained in the liner assembly body. Included in the view are the bearings and the reciprocation wave spring washers. Also illustrated is the static charge conductor plate.

FIG. 5 illustrates the position of the static charge conductor plate 280 mounted on the second end of the first assembly body ("first housing") 110. The charging plate is in electrical contact with the trajectory/static charging orifice 240 shown in FIG. 2. Illustrated are the liner fittings 152, 153 on the second end of the first ported body assembly (first housing) and the liner orifices 210, 211. Also illustrated in FIG. 5 are the rotating shaft 220 and the bearing 221 and the reciprocation wave spring washers 270 mounted on the rotating shaft. As the shaft rotates, the curved washers ride up and down on the counterpart washer pushing the shaft forward and back. The rotation of the curved washers pushes the dwell cone and rotational drive receptacle forward and back along the longitudinal axis of the pipe. There may also be a spring facilitating the forward and back motion. Also illustrated is the internal air assist component 275.

Figure 6:
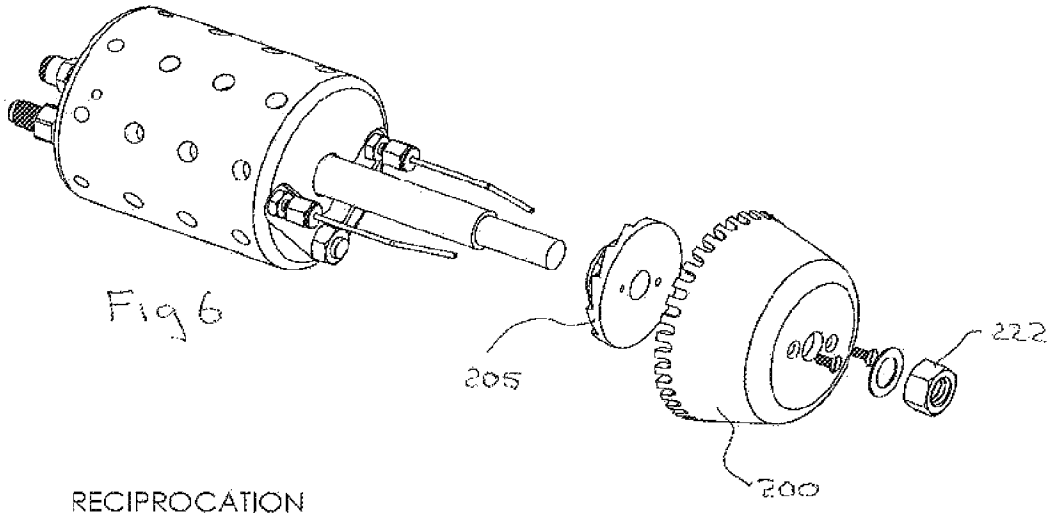
FIG. 6 illustrates an exploded view of the rotary shaft with the rotational drive receptacle and the dwell cone. Also illustrated are the two trajectory/static charging orifices attached to the liner assembly body.

FIG. 6 is an exploded view of the first housing 110 and the rotating shaft showing the relationship of rotational drive receptacle 205, dwell cone 200 and retaining nut 221.

Figure 7:
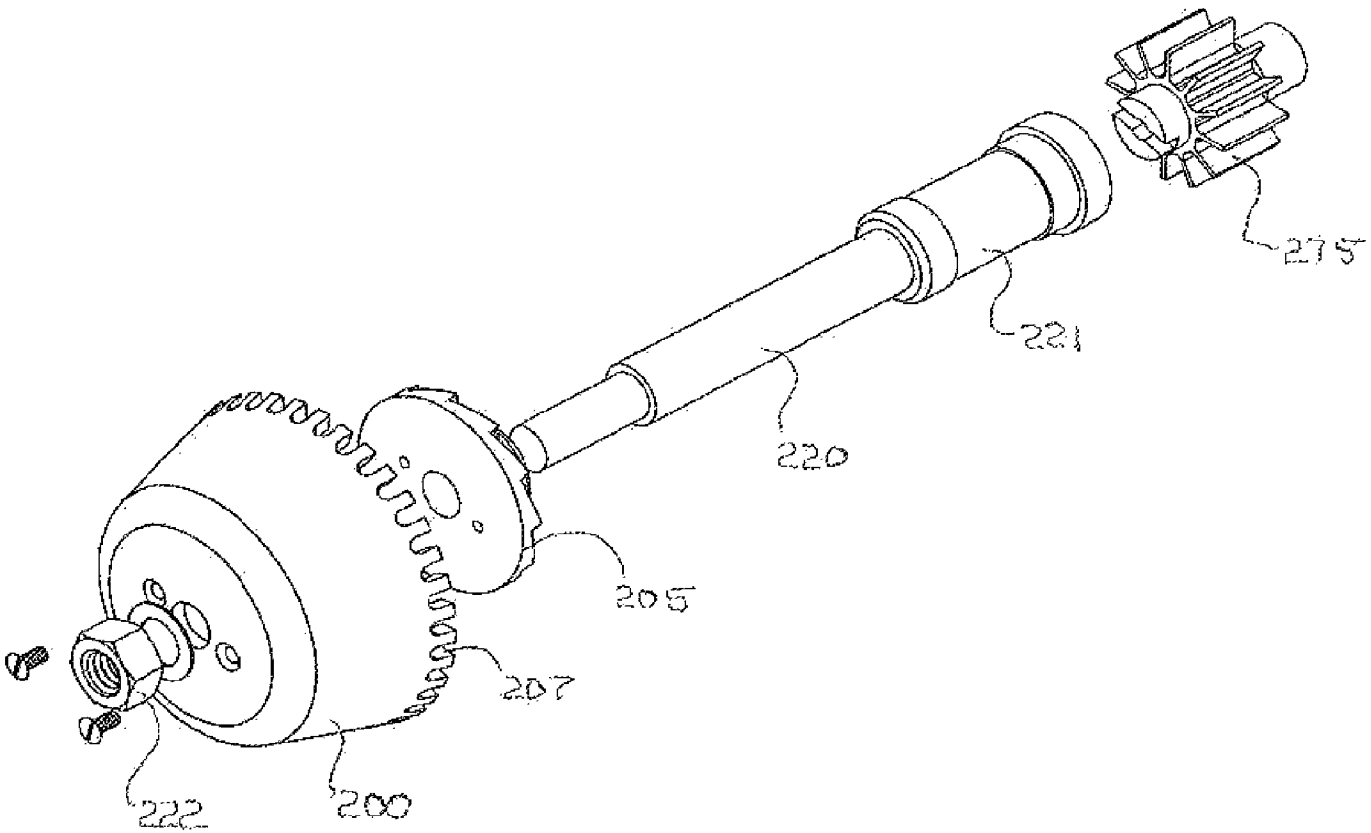
FIG. 7 is another exploded view of the rotary shaft with the internal air assist component, bearings, rotational shaft, rotational drive receptacle and the dwell cone and retaining nut.

FIG. 7 is another exploded schematic view of the internal air assist 275, rotating shaft 220, bearing 221, rotational drive receptacle 205, dwell cone 200, atomization knurls 207 and retaining nut 221.

It will be appreciated that the rotational drive receptacle and dwell cone rotate together as the pressurized lining mixture is emitted from the trajectory/static charging orifices.

Figure 8:
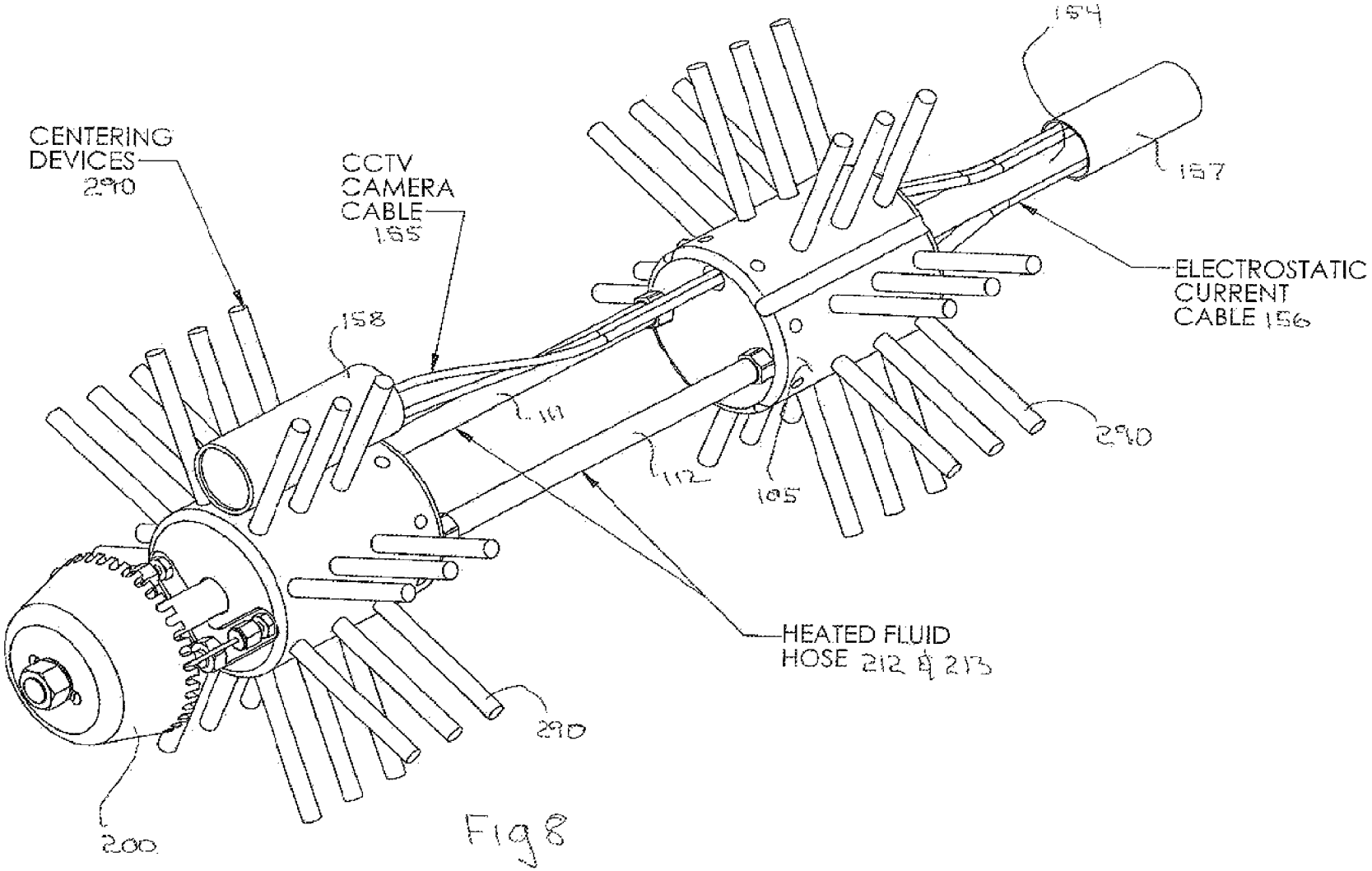
FIG. 8 is a schematic view showing the first ported assembly body, dwell cone, liner fluid delivery lines attached to the inlet portals and a second ported assembly body attached to the heated fluid hose, CCTV camera cable, CCTV camera and electrostatic current cable. Also illustrated are the centering components protruding from the first and second assembly bodies.

FIG. 8 illustrates the relationship of the second ported assembly body 105 and the first ported assembly body 110. Illustrated is the umbilical 157 containing a heated non-expanding lining mixture hose 154 conveying the mixed lining under pressure. It will be appreciated that the non-expanding lining mixture hose facilitates delivery of the mixture under pressure to the trajectory/static charging orifices. Also illustrated are the electrostatic current cable 156, CCTV camera cable 155 and camera 158.

The heated lining hose enters the first front end of the second ported body assembly 105. Within the assembly body, the lining mixture is branched into two lines flowing to the first ported body assembly 110 through tubes 111, 112 connected to the inflow fittings. The delivery hose is heatable and non-expanding. The liner is delivered with pressure.

Also illustrated in FIG. 5 are centering devices 290 mounted to the assembly bodies 105, 110. The prong or bristle like components maintain the device within the center of the pipe longitudinal axis, thereby ensuring an even coating of the lining on the pipe surface.

Figure 9:
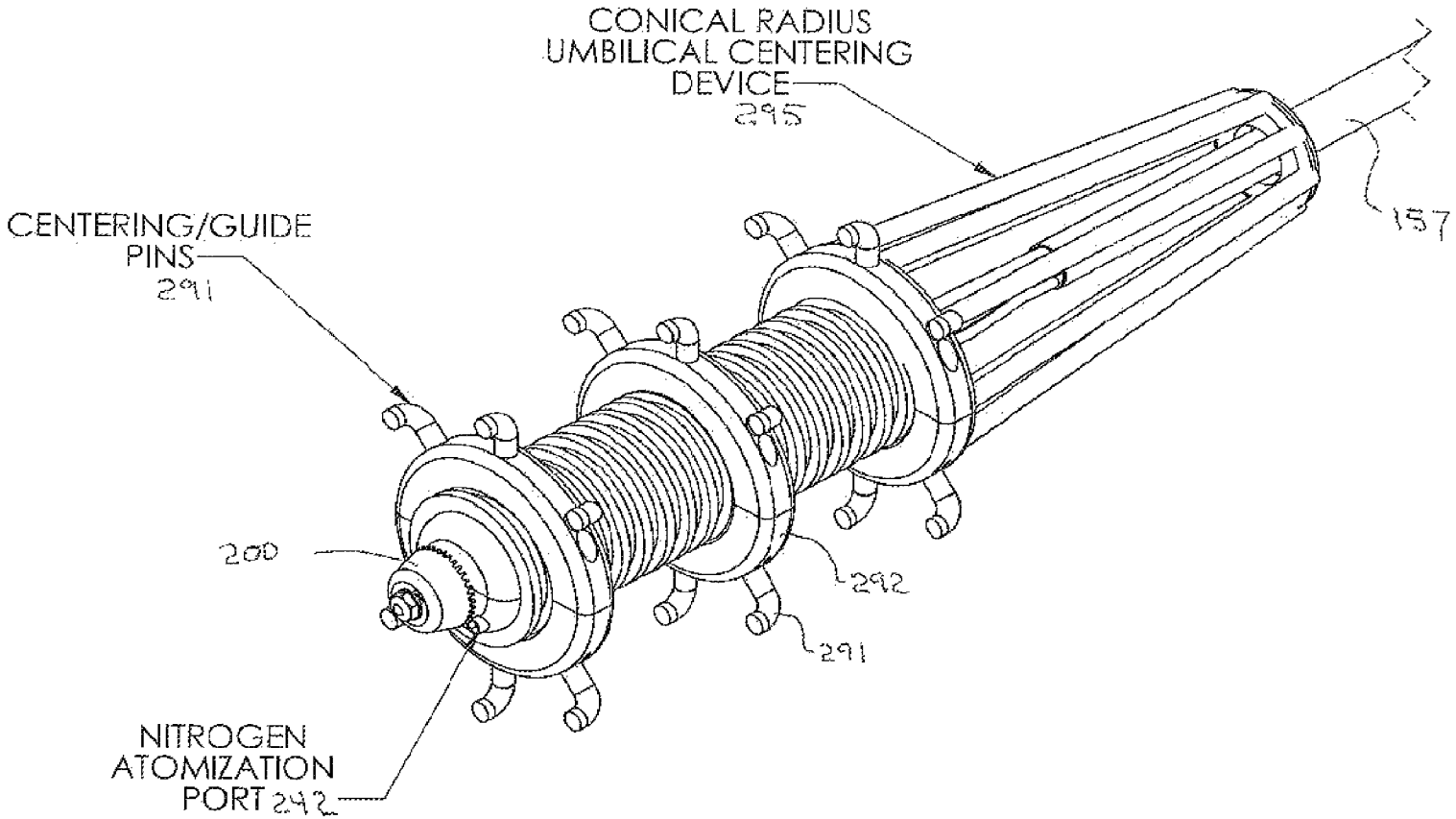
FIG. 9 illustrates a schematic view of the spray liner device including centering/guide pins mounted on centering/guide pin collars, a conical radius umbilical centering device, dwell cone and nitrogen atomization port.

FIG. 9 illustrates another embodiment of the imparted charge pipe lining device. Illustrated is the umbilical 157 comprising a heated liner hose, CCTV cable, electrical cable, air hose and an insulated nitrogen supply hose. The umbilical travels through a conical radius umbilical centering device 295. Also illustrated are center/guide pins 291 mounted on center/guide pin collars 292. Also illustrated is the nitrogen atomization port 242. The nitrogen atomization port emits chilled nitrogen gas into the lining stream. This chilled gas can facilitate a larger build up of lining material.

Figure 10:
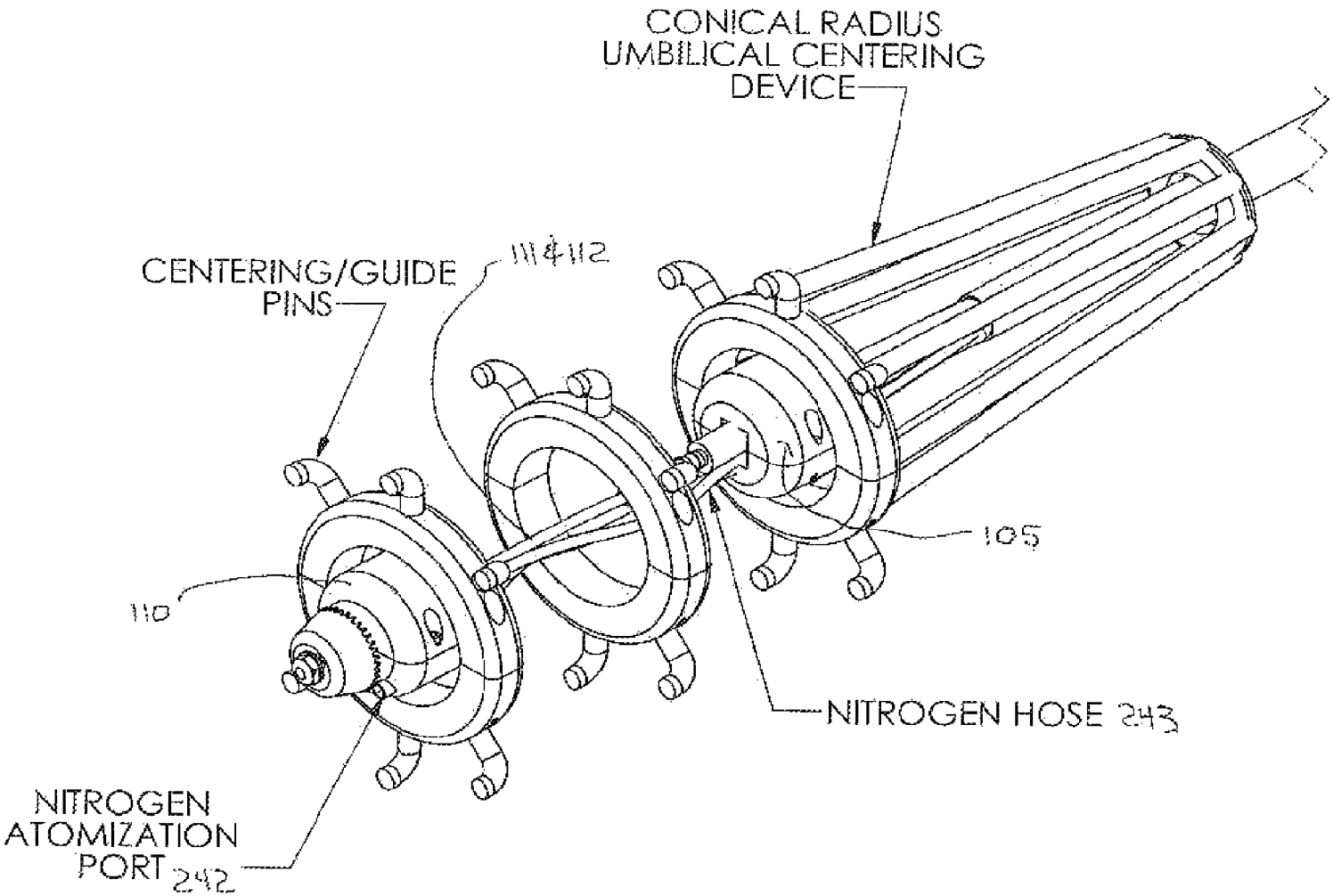
FIG. 10 illustrates another schematic view of the device illustrating the first housing, dual material feed hoses, nitrogen hose and second hosing.

FIG. 10 illustrates a schematic view of the imparted charge lining device with both the first housing 110 and second housing 105 visible. The nitrogen atomization port 242 and nitrogen gas hose 243 are also illustrated. Also shown are the dual feed hoses 111, 112 and the trajectory/static charging orifice 240.

Figure 11:
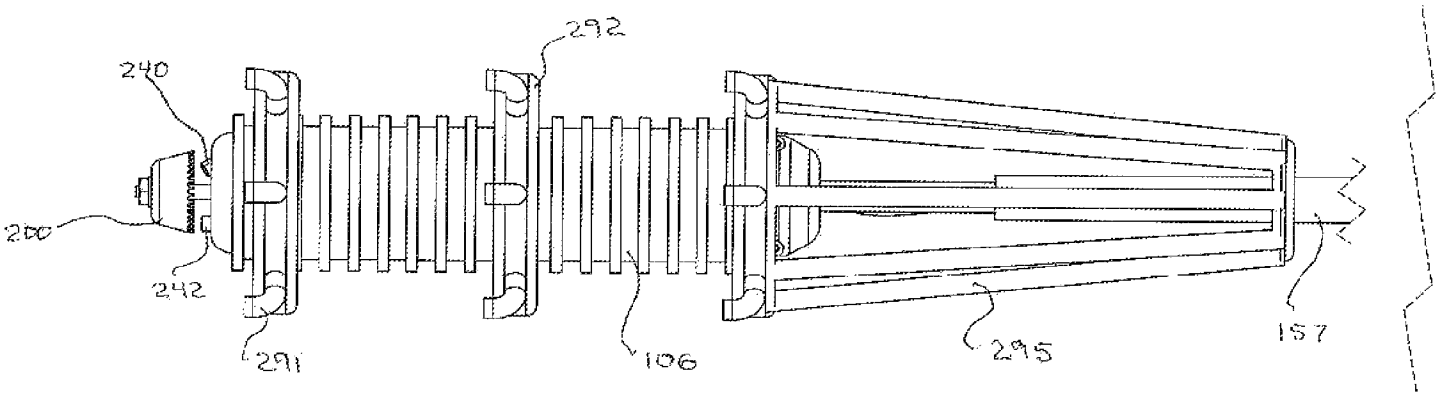
FIG. 11 illustrates a side view of the spray liner device illustrating the conical radius umbilical centering device, the centering/guide pins and collars, bendable/flexible housing and dwell cone.

FIG. 11 illustrates the centering/guide pins 291, centering/guide pin collars 292, conical radius umbilical centering device 295 and umbilical 157. The bendable/flexible housing 106 is illustrated coving the dual lining supply hoses, air hose and nitrogen hose.

Figure 12:
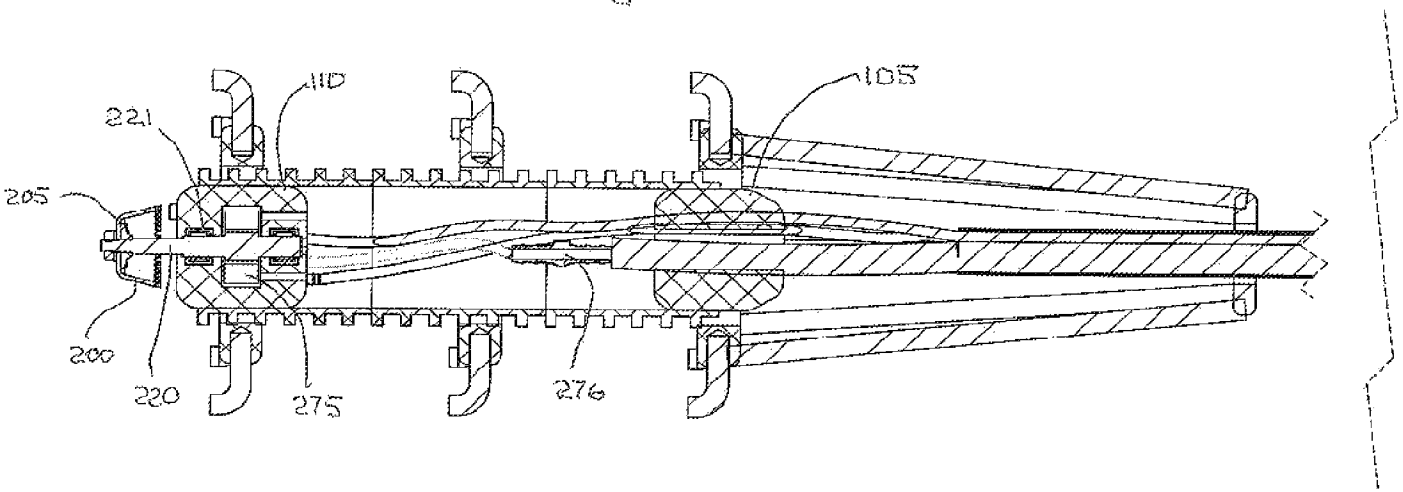
FIG. 12 illustrates a cross sectional view of the spray liner device.

FIG. 12 is a cross sectional view of the imparted charge static lining device showing the dwell cone 200, knurling edge 207, bearing 221, internal air assist 275 of the first housing 110, the second housing 105 and the folic housing chamber 276. The bendable/flexible housing 106 is also illustrated.

Figure 13:
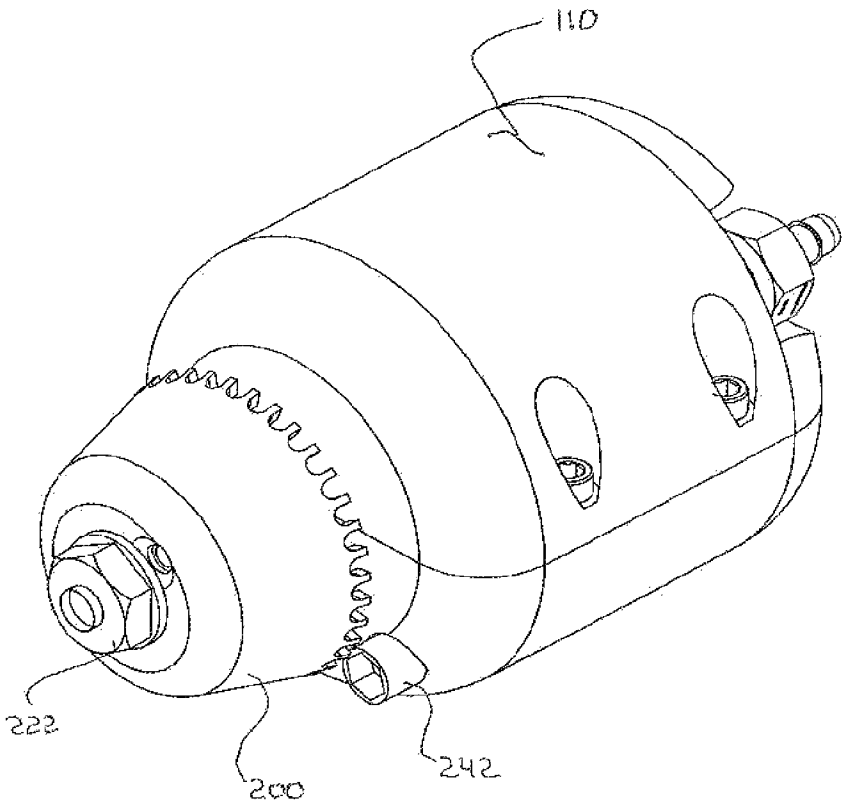
FIG. 13 illustrates the first housing with the dwell cone, retaining nut and nitrogen exit port.

FIG. 13 illustrates a perspective view of the first housing 110 with the nitrogen exit port 242, dwell cone 200 and retaining nut 222.

The combination dwell cone and the rotational drive receptacle are mounted on the free spinning rotary shaft. Both the dwell cone and the rotational drive receptacle are pressed up to a machined shoulder of the shaft and retained on the shaft with the retaining nut. The rotational drive receptacle has a pressed bearing to receive the shaft. The cone receives the fluid flow of the liner being cast centrifugally of the rotational drive receptacle and allows the lining mixture dwell time needed to cast the material in a consistent flow circumferentially. It is machined with atomization knurling at the edges circumferentially to allow the dissipation and atomization of the polyurea lining material in microscopic droplet form.

Figure 14:
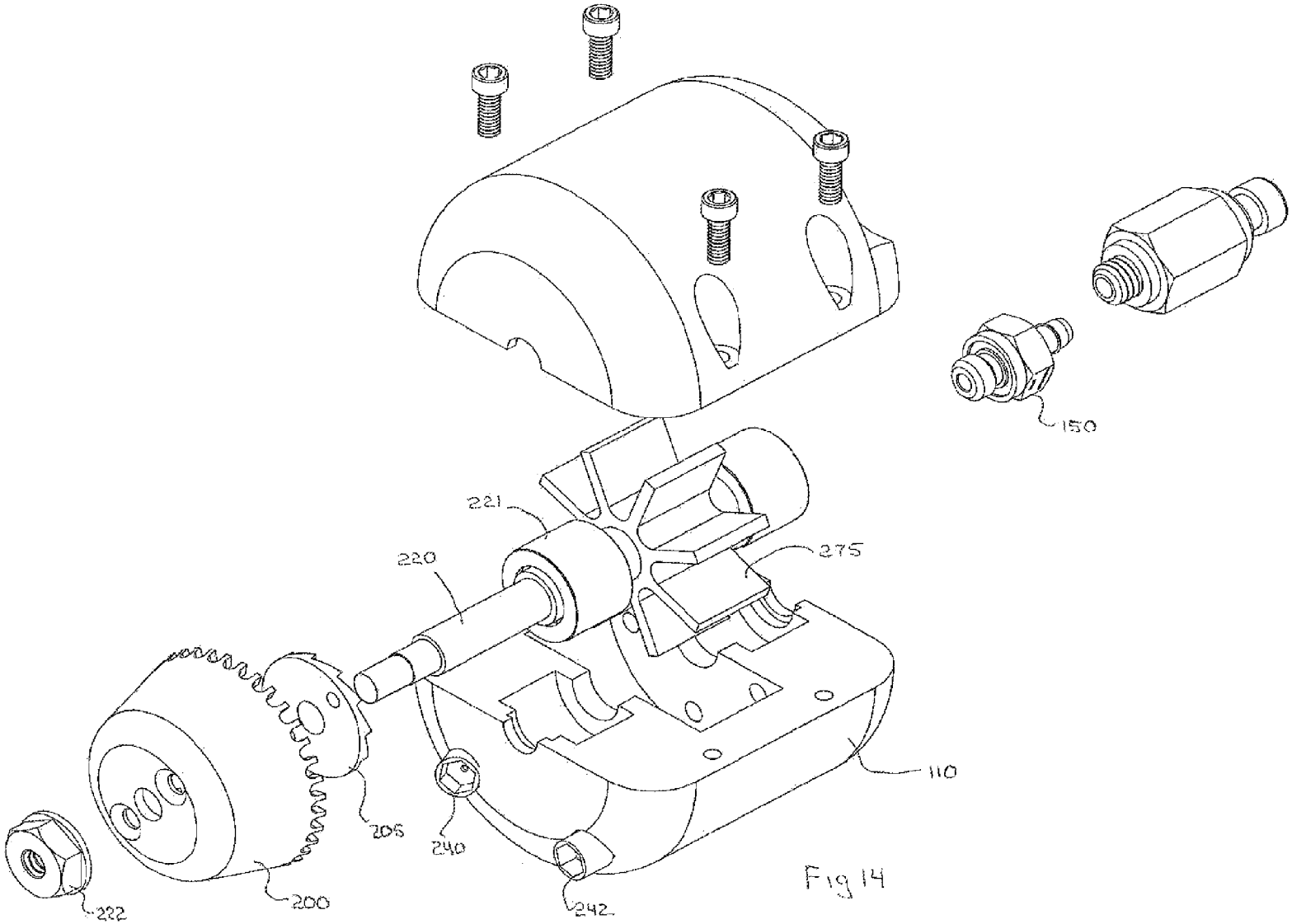
FIG. 14 illustrates a schematic exploded view of the first housing illustrating rotational drive receptacle, rotating shaft, bearings, internal air assist, trajectory static charging orifice and inflow fittings.

FIG. 14 illustrates an exploded perspective view of the first housing 110 illustrating the retaining nut 222, dwell cone 200, rotational drive receptacle 205, rotating shaft 220, bearing 221, internal air assist 275, trajectory static charging orifice 240, nitrogen exit port 242 and inflow fittings 150.

Figure 15:
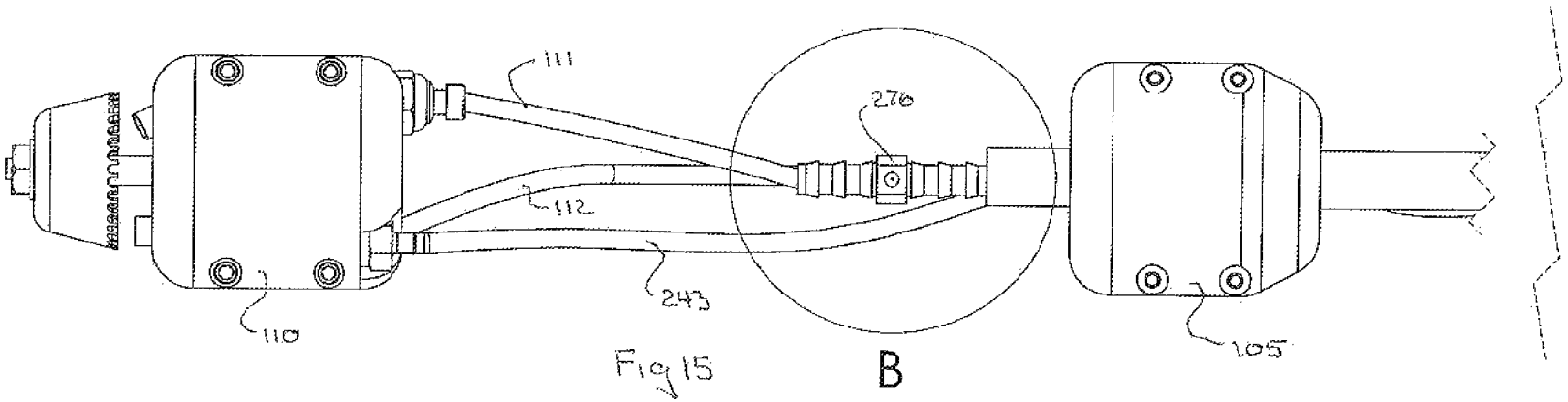
FIG. 15 illustrates the first and second housing, dwell cone and two liner feed hoses.
Figure 16:
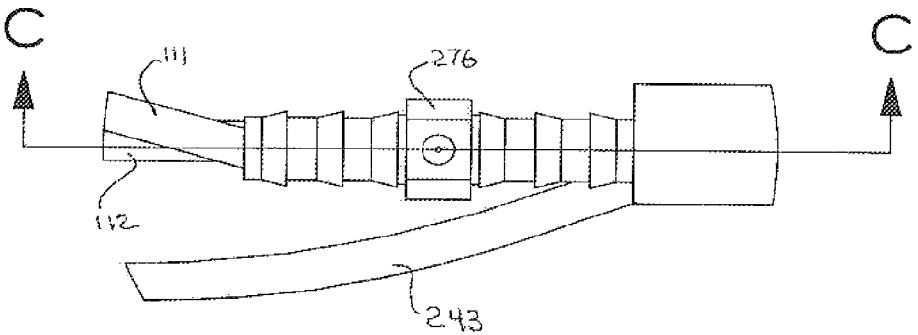
FIG. 16 illustrates the folic housing chamber.
Figure 17:
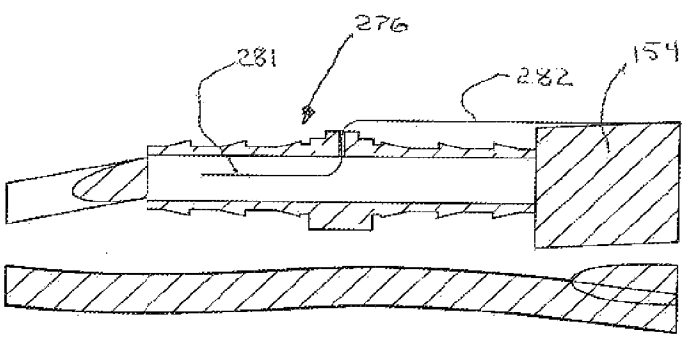
FIG. 17 illustrates a cross sectional view of the folic housing chamber.

FIG. 15 illustrates a side view of the first housing 110 and second housing 105 with the folic (element) housing chamber 276 where the electric charge is imparted on the lining material, the lining supply hoses 111, 112 exiting the element housing chamber and the nitrogen supply hose 243. FIG. 16 illustrates a detail of the folic (element) housing chamber 276 and the nitrogen supply hose 243. FIG. 17 illustrates a cross sectional view of the folic chamber 276 illustrating the electrically conductive wire 282 leading into the chamber and contacting the lining supply stream 281 from the heated lining supply hose 154.

Figure 18:
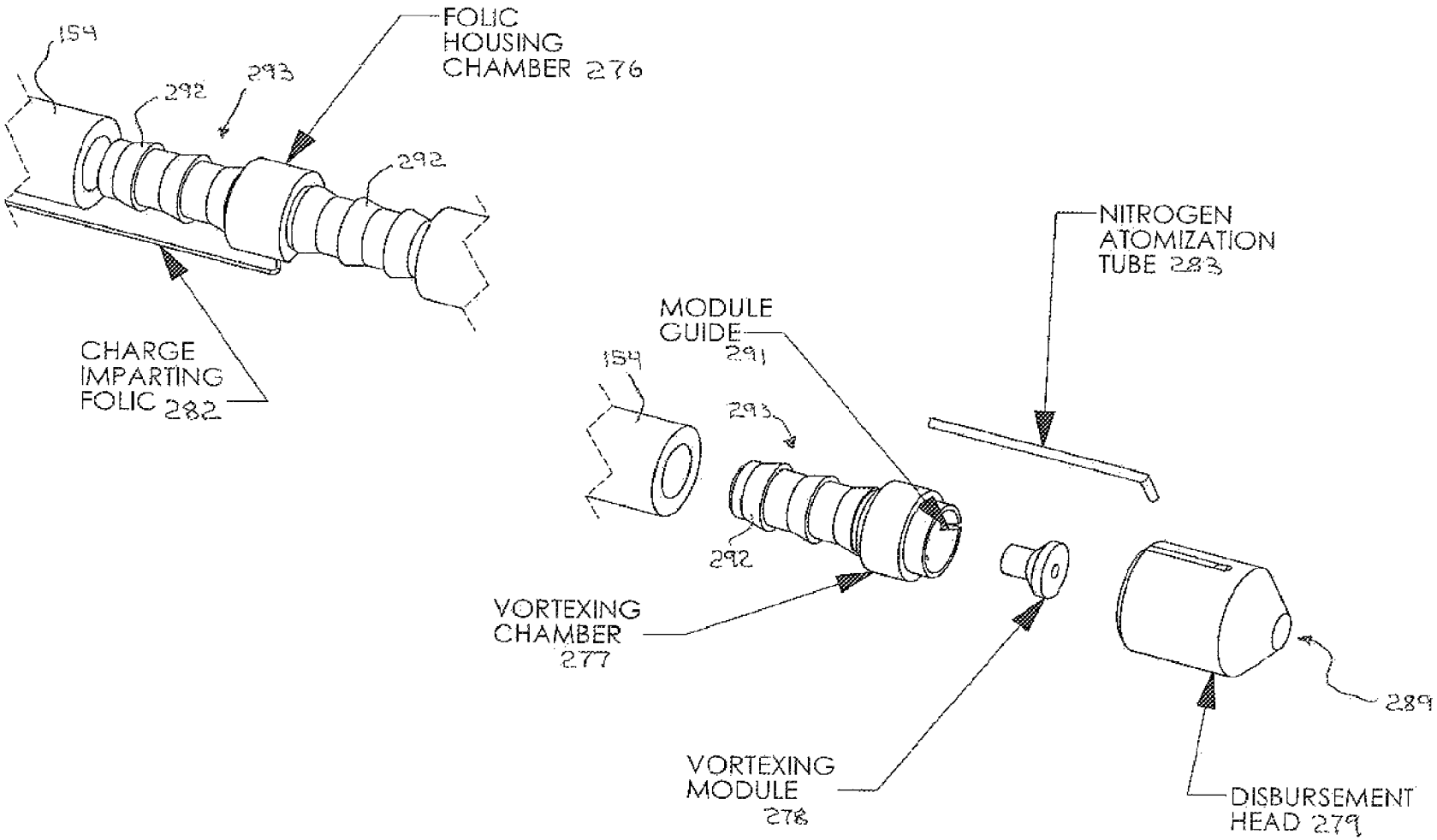
FIG. 18 illustrates a small diameter lining device.

FIG. 18 illustrates an exploded view of the small diameter imparted charge lining spray device which does not utilizes a spinning dwell cone or centrifugal force to disperse the lining on the inside of the pipe wall. The device emits an atomized spray of electrically charged lining material. The positively charged spray is electro-statically drawn to the negatively charge pipe wall surface. The device contains a heated supply hose 154 attached to the folic (element) housing chamber 276 utilizing hose insertion components 293 with circumferential hose barbs 292. Other hose attachment mechanisms can be used including clamps and threaded couplings. Also illustrated is a charge imparting wire 282 or charge imparting folic. Also illustrated is the disbursement head 279 receiving chilled nitrogen gas from the nitrogen atomization tube 283. It will be appreciated that the disbursement head may contain bristles or prongs to center the disbursement head in the pipe.

Figure 19:
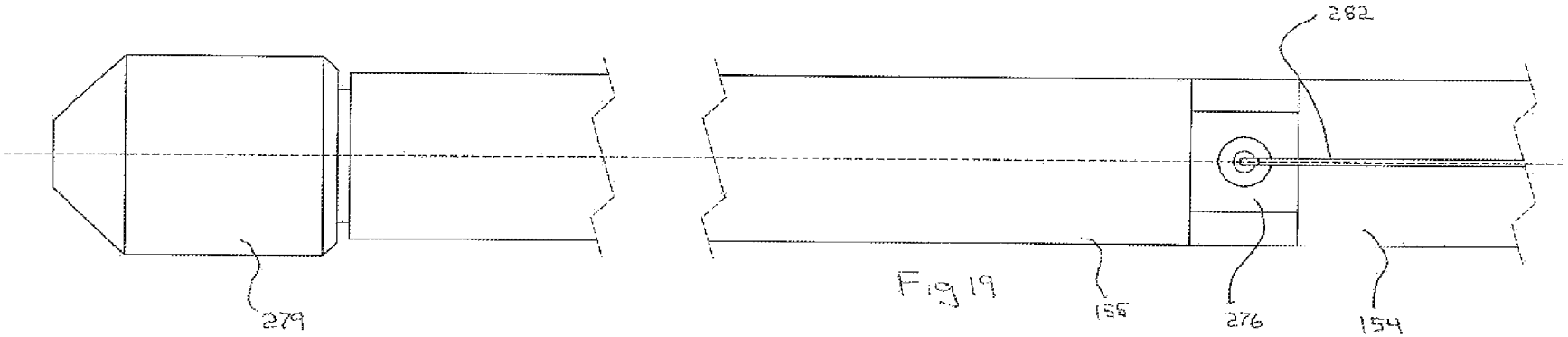
FIG. 19 illustrates a cross sectional view of the small diameter lining device comprising a heated hose conveying the lining mixture past a charge imparting folic to a conical atomization orifice and mixing chamber. Also illustrated is the nitrogen atomization tube.

FIG. 19 illustrates a side view of the small diameter imparted charge lining spray device showing the heated hose 154 connected to the folic (element) housing chamber 276 and additional (possibly unheated) hose 155. Also illustrated is the disbursement head 279.

Figure 20:
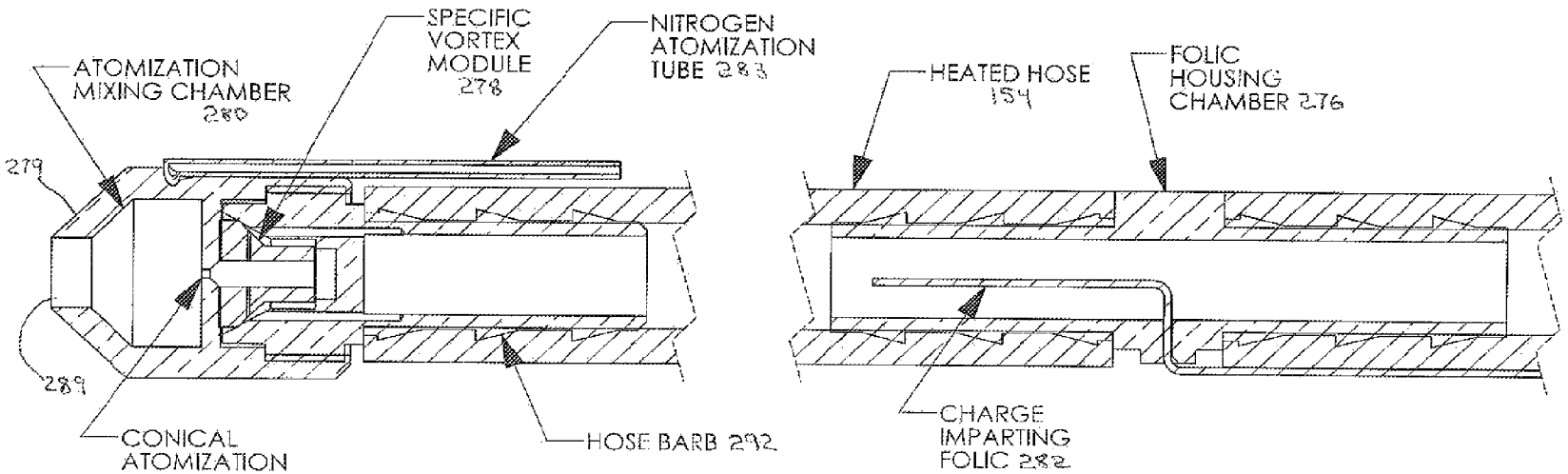
FIG. 20 illustrates a schematic exploded view of the small diameter lining device. Illustrated is the charge imparting folic and housing chamber, heated hose and hose connections, the vortexing chamber, vortexing module, nitrogen atomization tube and disbursement head.

FIG. 20 illustrates a cross sectional view of the small diameter imparted charge lining spray device showing the folic (element) housing chamber 276 attached to the heated hose 154 and the charge imparting folic (electrical element) 282. Also illustrated are the hose barb attachment mechanism 292, the conical atomization orifice 281, the specific vortex module 278, the atomization mixing chamber 280 and disbursement head 279.

In one embodiment, the lining mixture comprises isocyanate and amine terminated resin. This mixture forms a polyurea lining. The lining mixture can be mixed at a pump located proximate to the pipe access. The lining may be heated while conveyed through the hose to the lining device. This will maintain a low viscosity. The lining mixture can include quaternary ammonium ethosulfates, ethoxylated amines or glycerol esters. These additives facilitate the addition of a positive charge within the lining mixture by the static charge conductor plate. This draws the charged lining particles to the negatively charged (grounded) pipe wall surface. This electrostatic attraction force holds the lining material tightly to the pipe wall during cure and without drips or sags. The polyurea lining may not have an accelerated cure time.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention may be utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

What we claim is:

1. A pipe lining apparatus comprising:

a) an umbilical containing at least one heated hose conveying liquid lining material under pressure, a nitrogen fluid conveying hose and an electrical cable;

b) an electrical element within a housing chamber in communication with the electrical cable wherein the electrical element is in contact with the liquid lining material prior to atomization;

c) a vortexing chamber with a vortexing module in communication with a conical atomization orifice;

d) the conical atomization orifice leading to an atomization mixing chamber;

e) a nitrogen atomization tube in fluid communication with the atomization mixing chamber within a disbursement head; and f) a spray liner orifice.

2. The pipe lining apparatus of claim 1 further comprising an electrically charged lining material.

3. The pipe lining apparatus of claim 1 wherein the nitrogen supply hose is insulated.

4. The pipe lining apparatus of claim 1 wherein the nitrogen supply hose is in contact with a portion of the lining supply hose.

5. The pipe lining apparatus of claim 1 further comprising the liquid lining material containing quaternary ammonium ethosulfates, ethoxylated amines or glycerol esters.

6. The pipe lining apparatus of claim 1 further comprising bristles or prongs to center the disbursement head in the pipe.

7. The pipe lining apparatus of claim 1 further comprising a positively charged atomized lining emitted from the spray liner orifice.

8. The pipe lining apparatus of claim 1, wherein the pipe lining apparatus is dimensioned to fit within a pipe having an inside diameter of ¾ inch.

* * * * *